US006242861B1

(12) United States Patent
Nakagawa

(10) Patent No.: US 6,242,861 B1
(45) Date of Patent: Jun. 5, 2001

(54) DIRECT CURRENT DISCHARGE LAMP AND LIGHT SOURCE HAVING THE DISCHARGE LAMP ATTACHED TO REFLECTOR

(75) Inventor: Atsuji Nakagawa, Himeji (JP)

(73) Assignee: Phoenix Electric Co., Ltd., Himeji (JP)

( * ) Notice: Subject to any disclaimer, the term of this patent is extended or adjusted under 35 U.S.C. 154(b) by 0 days.

(21) Appl. No.: 09/153,297

(22) Filed: Sep. 15, 1998

(30) Foreign Application Priority Data

Sep. 19, 1997 (JP) ..... 9-273821

(51) Int. Cl.[7] ..... H01J 61/36
(52) U.S. Cl. ..... 313/623; 313/632; 313/113
(58) Field of Search ..... 313/623, 631, 313/632, 634, 624, 625, 113

(56) References Cited

U.S. PATENT DOCUMENTS 3,324,332 * 6/1967 Waymouth et al. ..... 313/623
4,891,553 * 1/1990 Bamburg et al. ..... 313/113
4,937,496 * 6/1990 Neiger et al. ..... 313/632
5,486,737 * 1/1996 Hrubowchak et al. ..... 313/634
5,569,978 * 10/1996 Oiye et al. ..... 313/631

* cited by examiner

*Primary Examiner*—Nimeshkumar D. Patel
*Assistant Examiner*—Joseph Williams
(74) *Attorney, Agent, or Firm*—Oblon, Spivak, McClelland, Maier & Neustadt, P.C.

(57) ABSTRACT

A direct current discharge lamp includes: a bulb portion 1*a* containing therein an anode 2*b* and a cathode 2*a*; a first seal portion 5 outwardly extending from the bulb portion 1*a* on the anode side; a second seal portion 4 outwardly extending from the bulb portion 1*a* on the cathode side; a pair of feeder elements 3 respectively inserted through the first and second seal portions 5 and 4 for feeding electricity to the anode 2*b* and cathode 2*a*; and an extended tube portion 6 interconnecting the bulb portion 1*a* and the first seal portion 5.

14 Claims, 5 Drawing Sheets

DIRECT CURRENT DISCHARGE LAMP AND LIGHT SOURCE HAVING THE DISCHARGE LAMP ATTACHED TO REFLECTOR

BACKGROUND OF THE INVENTION

1. Field of the Invention

The present invention relates generally to direct current discharge lamps and, more particularly, to improvements in a direct current discharge lamp for use in an optical instrument and to an improved light source using such lamp as attached to a reflector.

2. Description of the Related Art

Discharge lamps such as extra-high pressure mercury lamps and metal halide lamps are widely used in optical instruments such as liquid crystal projectors, OHPs and motion picture projectors and in general lightings. Such discharge lamps are highly advantageous in that their energy efficiency is three to five times higher than that of incandescent lamps such as halogen lamps, which emit light by heating filament, and their life time is five to ten times longer than that of such incandescent lamps.

Recently, demands have arisen from users, particularly from users of optical instruments that discharge lamps be further improved in life time, energy efficiency (specifically, to achieve a higher screen brightness per electric power applied to lamps) and evenness of screen brightness.

Intensive study and development have been made to improve discharge lamps for use in optical instruments so as to satisfy such demands; for example, enabling lamps to use direct current in order to enhance their emission efficiency in optical instruments, shortening the spacing between opposite electrodes to shorten the arc length or increasing the pressure in the lamps thereby improving the luminance of arc, and improving the reflecting efficiency of a reflector based on an improved arc luminance.

FIG. 4 shows a conventional discharge lamp (B). This conventional lamp (B) involves the following problems: (1) anode 12*b*, which is heated to a higher temperature than cathode 12*a* in DC lighting, is subjected to severe damage and loss, resulting in a substantial luminous flux attenuation from the initial period of use, hence in an unsatisfactory life time (refer to FIG. 5); (2) seal-cut portion 27 of bulb 21*a* interfere with the light path to cause a 10 to 20% loss in lighting efficiency (refer to Table 1); (3) the seal-cut portion 27 is reflected on a screen as shadow causing uneven screen brightness (refer to Table 2); and like problems.

To solve the problems (2) and (3) of the above problems, study has made to develop tipless lamps which are fabricated without using any sealing tube so as to avoid formation of any seal-cut portion as indicated at 27. Such tipless lamps are now being realized for a lower wattage.

Such tipless technique, however, involves not a few problems remaining unsolved. The first one is unfeasibility of obtaining lamps of a higher wattage due to process limitations. Specifically, a higher wattage lamp requires the use of a glass tube having a thicker wall and a larger diameter and this makes it difficult to achieve tipless sealing. The second one is incapability of preventing malfunction of a lamp due to impurities produced in the lamp. Specifically, in the manufacturing process of even a lower wattage lamp, certain amounts of impurities are produced from a glass tube used. The amounts of impurities grow larger as the wattage of a lamp grow higher because such a higher wattage lamps employs a larger glass tube. Larger amounts of impurities remaining in the lamp cause malfunction of the lamps. The third one is costly manufacture, which leads to expensive optical instruments such as a projector. Moreover, the problem (1) is left unsolved.

It is, therefore, an object of the present invention to provide a direct current discharge lamp having a prolonged life time.

Another object of the present invention is to provide a direct current discharge lamp enjoying an improved energy efficiency.

Yet another object of the present invention is to provide a direct current discharge lamp providing improved evenness in screen brightness.

Further object of the present invention is to provide a direct current discharge lamp of a higher wattage and to enable the manufacturing cost of a direct current discharge lamp to be reduced.

SUMMARY OF THE INVENTION

According to the present invention, there is provided a direct current discharge lamp comprising a bulb portion containing therein an anode and a cathode, a first seal portion outwardly extending from the bulb portion on the anode side, a second seal portion outwardly extending from the bulb portion on the cathode side, a pair of feeder elements respectively inserted through the first and second seal portions for feeding electricity to the anode and cathode, and a extended tube portion interconnecting the bulb portion and the first seal portion.

With a conventional direct current discharge lamp, when the lamp is turned on, arc is produced between the anode and the cathode and electrons are emitted from the cathode toward the anode. This heats the anode to a high temperature with the result that the anode material is evaporated and scattered within the bulb portion to cause darkening of the bulb portion.

With the direct current discharge lamp of the above construction according to the present invention, in contrast, the provision of the extended tube portion which serves to extend the space adjacent the based portion of the anode allows the heat of the anode to dissipate easily. This suppresses the evaporation of the anode material from the anode, hence the darkening of the bulb portion. As a result, luminous flux attenuation is mitigated to prolong the lamp life time.

Preferably, the anode is extended from the bulb portion into the extended tube portion. This feature enables the anode to be lengthened relative to a conventional one. Such a lengthened anode has an increased heat capacity and allows easier heat dissipation thereby suppressing excessive heating of the anode. This advantage results in the lamp enjoying a further prolonged life time.

In a preferred embodiment the extended tube portion is formed with a seal-cut portion. Usually such a seal-cut portion is formed on the bulb portion as a trace of introducing filler substances (gases or the like) into the bulb portion and hence interferes with light passing therethrough. However, the advantageous feature according to the present invention that the seal-cut portion is located on the extended tube portion allows light from the luminous spot appearing adjacent the leading end of the cathode and from a region immediately next to the luminous spot to advance outwardly of the lamp without interference of the seal-cut portion. Thus, a screen when illuminated by such lamp is free of any shadow attributable to the seal-cut portion, resulting in a more even screen brightness.

The present invention also provides a light source comprising a reflector and a direct current discharge lamp, the lamp comprising a bulb portion containing therein an anode and a cathode, a first seal portion outwardly extending from the bulb portion on the anode side, a second seal portion outwardly extending from the bulb portion on the cathode side, a pair of feeder elements respectively inserted through the first and second seal portions for feeding electricity to the anode and cathode, and an extended tube portion interconnecting the bulb portion and the first seal portion and formed with a seal-cut portion, the first seal portion of the lamp being inserted into a central mounting hole of the reflector.

With this construction, the seal-cut portion is located adjacent the central mounting hole of the reflector, and even if light passing through the seal-cut portion is reflected by the reflector, such light does not pass through a liquid crystal panel or aperture of an optical instrument which restricts light adapted to illuminate the screen. Thus, any shadow caused by the seal-cut portion is not formed on the screen.

The foregoing and other objects, features and attendant advantages of the present invention will become apparent from the following detailed description of the preferred embodiments of the invention when read in conjunction with the accompanying drawings, in which:

BRIEF DESCRIPTION OF THE DRAWINGS

FIG. 3 is an explanatory sectional view showing a light source in which the direct current discharge lamp according to the second embodiment is mounted to a reflector and turned on;

DETAILED DESCRIPTION OF THE PREFERRED EMBODIMENTS

The present invention will now be described in detail with reference to the drawings.

Figure 1:
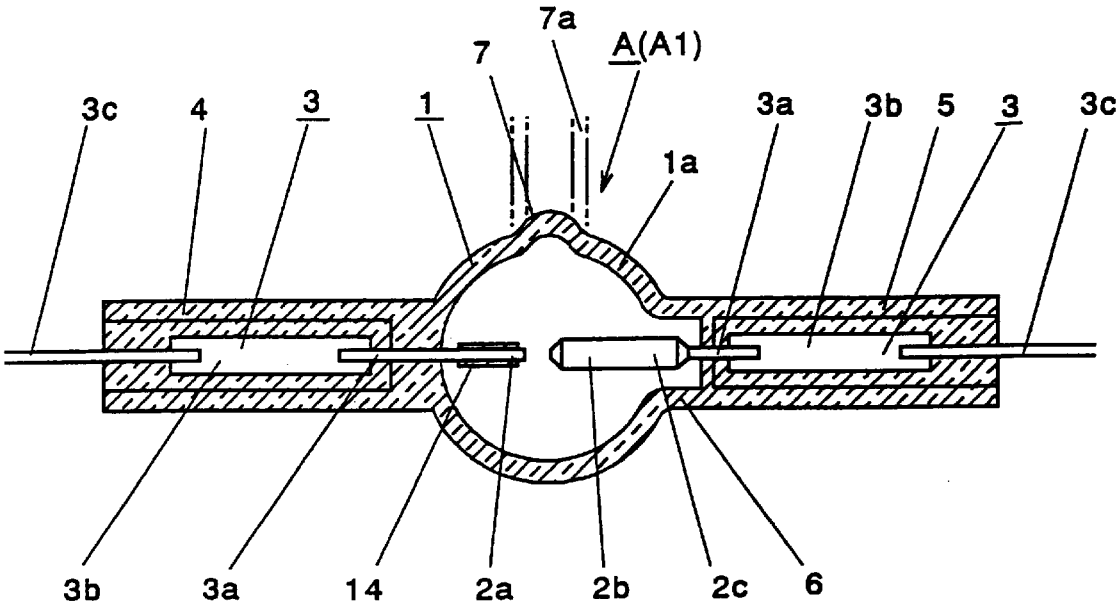
FIG. 1 is a sectional view showing a direct current discharge lamp according to a first embodiment of the present invention.

Referring to FIG. 1 showing a representative DC discharge lamp (A1) according to a first embodiment of the present invention, the lamp (A1) includes a lamp envelope 1 formed of quartz glass and comprising a spherical bulb portion 1*a*, a rectangular seal portion 4 outwardly extending from one side of the bulb portion 1*a*, an extended tube portion 6 outwardly extending from the opposite side of the bulb portion 1*a*, and another seal portion 5 extending outwardly from the extended tube portion 6. The bulb portion 1*a* may be shaped otherwise, for example, like a rugby ball or elongated ellipse in section.

A seal-cut portion 7 formed on the bulb portion 1*a* is a vestige of a thin tube 7*a* shown in phantom, the thin tube 7*a* having been in communication with the bulb portion 1*a* so as to feed filler substances (gases) therethrough into the bulb portion 1*a* and then sealed by heat cutting.

The extended tube portion 6 is a straight tube having an outer diameter smaller than the largest outer diameter of the bulb portion 1*a* and an inner diameter larger than the outer diameter of anode 2*b*. Each of the seal portions 4 and 5 is shaped rectangular by a known pinch sealing process and airtightly contains a feeder element 3 extending therethrough from the corresponding electrode (anode 2*b* or cathode 2*a*).

The feeder element 3 comprises an inner lead pin 3*a* joined or welded with the corresponding electrode 2*a* or 2*b*, an outer lead pin 3*c* outwardly extending from the corresponding seal portion 4 or 5, and a sealing foil 3*b* of molybdenum embedded in the seal portion 4 or 5 and welded with the inner and outer lead pins 3*a* and 3*c* at opposite ends thereof.

In the present invention, the cathode 2*a* typically comprises a thin tungsten pin which serves also as the inner lead pin 3*a*, and a thick portion 14 comprising a tungsten coil or sleeve attached to the inner end of the thin tungsten pin, while the anode 2*b* typically comprises a thick tungsten pin having a larger diameter than the cathode 2*a* which is shaped into a truncated corn. Such features are employed because direct current is used.

The electrodes 2*a* and 2*b* face opposite each other with a predetermined spacing therebetween at a substantially central location in the bulb portion 1*a*. The spacing between the electrodes is 1.5 to 2 mm in the embodiment, typically 0.5 to 3 mm, but not limited thereto.

The characteristic feature of the present invention which is highly advantageous over the prior art consists in that the provision of the extended tube portion 6 enables the anode 2*b* to be lengthened extending from the substantially central location in the bulb portion 1*a* into the extended tube portion 6 since the extended tube portion 6 has an inner diameter larger than the outer diameter of the anode 2*b* and hence accommodates base portion 2*c* of the anode 2*b* with a sufficient spacing therebetween. This allows the anode 2*b* to have a greater heat capacity than the conventional one and the space within the extended tube portion 6 to be used for heat dissipation from the anode 2*b*. It is, of course, possible to use an anode having the same length as the conventional one and to utilize the extended tube portion 6 only as a heat dissipation space extending behind the anode.

Predetermined amounts of filler substances such as mercury, argon gas, other required filler gases and metal halides are encapsulated in the bulb portion 1*a* through the thin tube 7*a* which is sealed and cut by heating the base portion thereof after the completion of introduction of the filler substances. The seal-cut portion 7 is the vestige of sealing and cutting of the thin tube 7*a*.

When the direct current discharge lamp (A1) thus constructed is turned on, arc is produced between the cathode 2*a* and the anode 2*b* and electrons are emitted from the cathode 2*a* toward the anode 2*b* thereby heating the anode 2*b*. The additional space provided around the base portion of the anode 2*b* by the extended tube portion 6 enables the anode 2*b* to dissipate heat easily. As a result, evaporation and scattering of the anode forming material is suppressed and, hence, darkening of the bulb portion 1*a* is suppressed. This mitigates the luminous flux attenuation of the lamp, resulting in the lamp enjoying a prolonged life time.

Though not shown, it is possible to shorten the anode 2*b* to have the same length as the conventional one and extend the inner lead pin 3*a* so as to pass through the extended tube portion 6. This construction also allows easy heat dissipation by virtue of the extended space provided by the extended tube portion 2*b* and hence suppresses the loss of the anode forming material.

Figure 2:
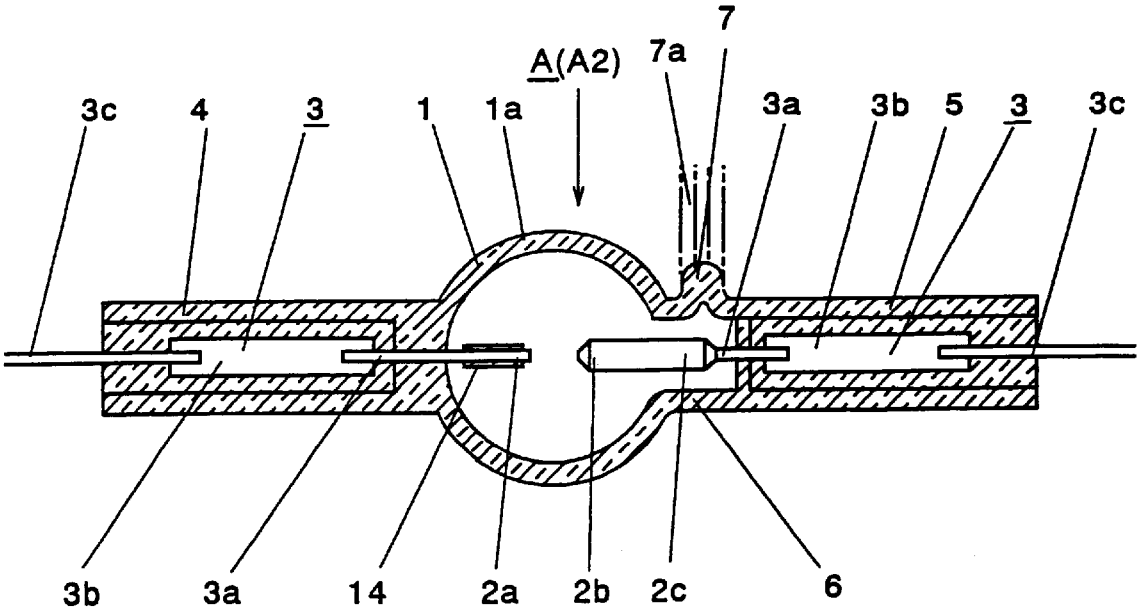
FIG. 2 is a sectional view showing a direct current discharge lamp according to a second embodiment of the present invention.
Figure 3:
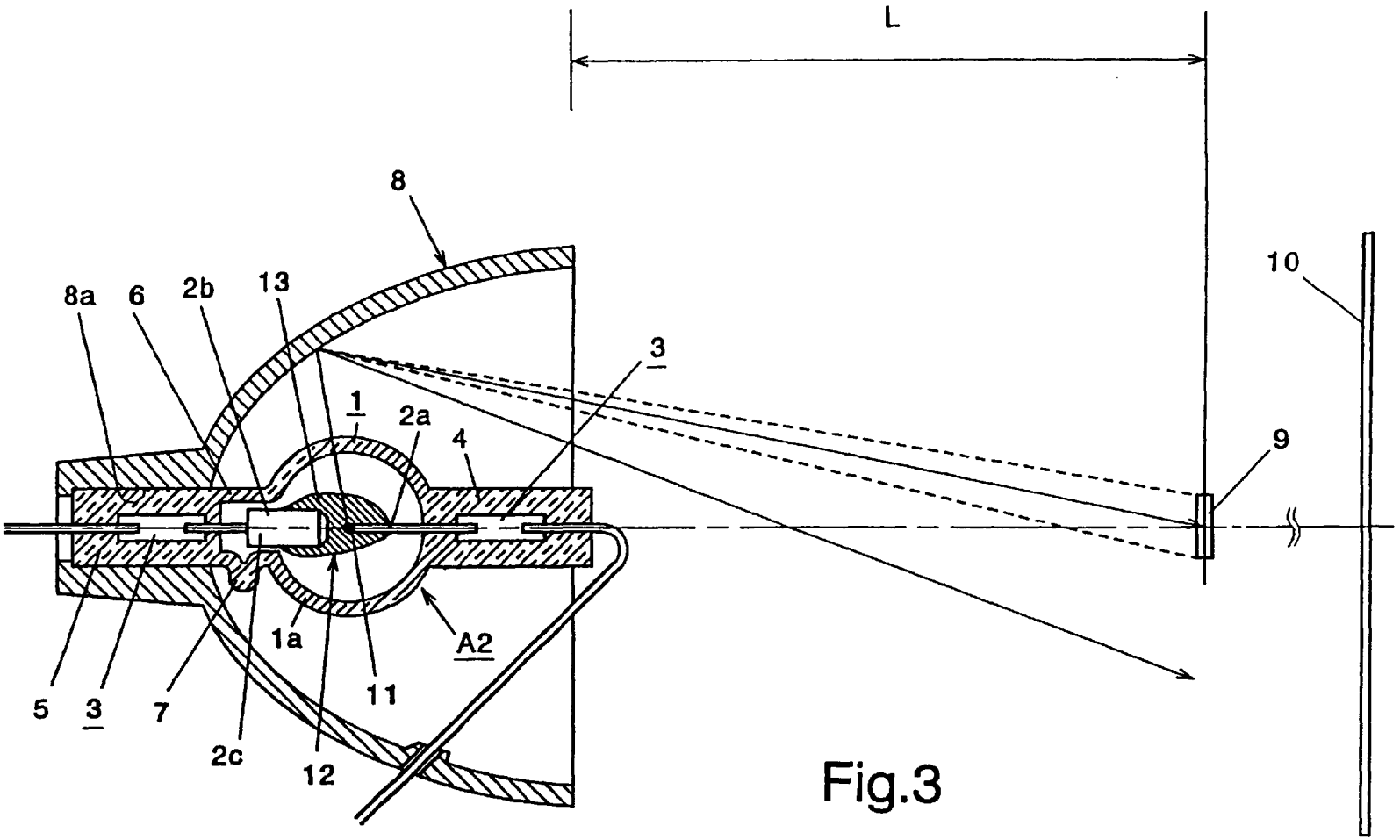

Referring to FIG. 2 showing a direct current discharge lamp (A2) according to a second embodiment of the present invention, features different from those of the first embodiment are described in detail and the description of common features is omitted.

In the second embodiment seal-cut portion 7 is formed on extended tube portion 6 unlike the first embodiment. The second embodiment provides the following advantages in addition to those provided by the first embodiment.

That is, since the seal-cut portion 7 is located on the extended tube portion 6, light from luminous spot 11 appearing adjacent the cathode 2*a* and from a region immediately next to the luminous spot 11 is outwardly emitted through the bulb portion 1*a* without interference of the seal-cut portion 7. Thus, the lamp (A2) according to the second embodiment does not cause a shadow attributed to the seal-cut portion 7 on a screen, thereby ensuring an improved evenness in screen brightness.

The lamp (A2) thus constructed can advantageously used as a light source incorporated in an optical instrument as well as for general lighting. In such optical instrument the lamp (A2) is usually attached to a reflector 8. In this case the seal-cut portion 7 located on the extended tube portion 6, which would be responsible for a decreased evenness in screen brightness and for a shadow if it is located on the bulb portion 1*a* as in the lamp (A1), does not cause any decrease in screen brightness such as a decreased evenness in luminance and a shadow. Thus, the lamp (A2) is capable of improving the evenness in screen brightness and eliminating shadow on the screen.

Specifically, when direct current is applied to the lamp (A2), arc 12 comprising luminous spot 11 appearing adjacent the cathode 12 and a light-emitting portion 13 surrounding the luminous spot 11 is produced between the electrodes 2*a* and 2*b*. In attaching the lamp (A2) to reflector 8 the seal portion 5 on the anode side is inserted into tubular portion 8*a* of the reflector 8 so that the luminous spot 11 coincides with the focus of the reflector 8, and then fixed thereto with an adhesive or a metal fixture.

In a certain type of optical instrument the lamp (A2) attached to the reflector 8 as a light source is located behind an LCD panel. A portion of light from the lamp (A2) passes through liquid crystal portion 9 of the LCD panel or an aperture to form an image on the screen 10, while other portions of light which do not pass through the liquid crystal portion 9 or the aperture do not reach the screen 10.

Figure 4:
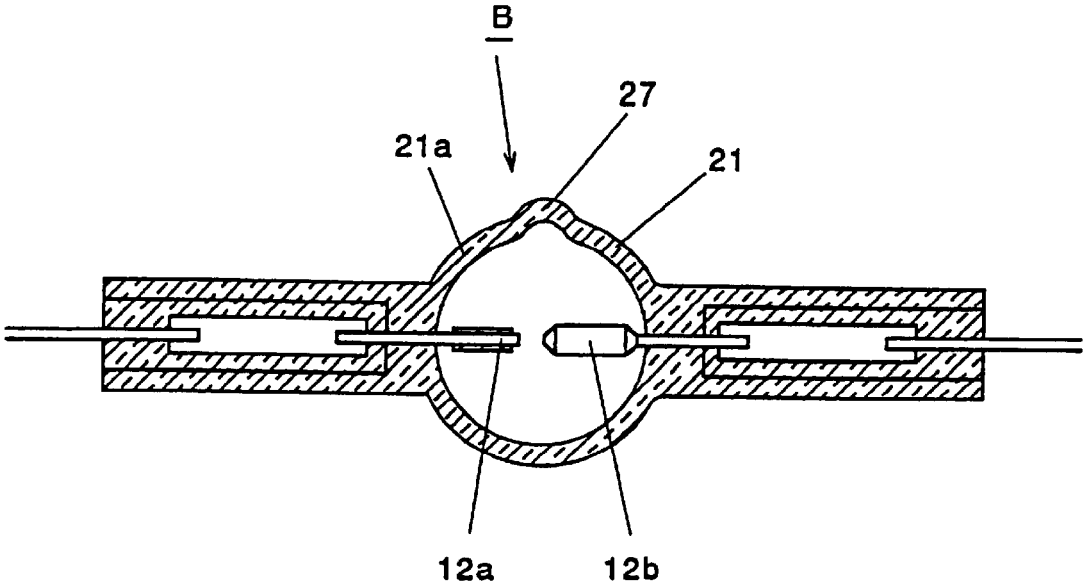
Fig.4 PRIOR ART
FIG. 4 is a sectional view showing a conventional direct current discharge lamp.

With a conventional direct current discharge lamp (B) having a seal-cut portion on a bulb portion as shown in FIG. 4, light passing through the seal-cut portion 27 on the bulb portion 21*a* reaches the screen through the liquid crystal portion 9 or the aperture to cause a shadow on the screen 10.

With the lamp (A2) of the present invention, in contrast, light passing through the bulb portion 1*a* and the liquid crystal portion (9) or the aperture is entirely free of distortion and hence never causes any shadow on the screen.

EXAMPLE 1

The life time of lamp (A) according to the present invention was compared with that of the conventional lamp (B). The results are shown in FIG. 5 in which the ordinate represents luminous flux attenuation (%), the abscissa represents time; curve (A) represents the luminous flux attenuation of the lamp (A2) according to the present invention; and curve (B) represents the luminous flux attenuation of the conventional lamp (B).

Figure 5:
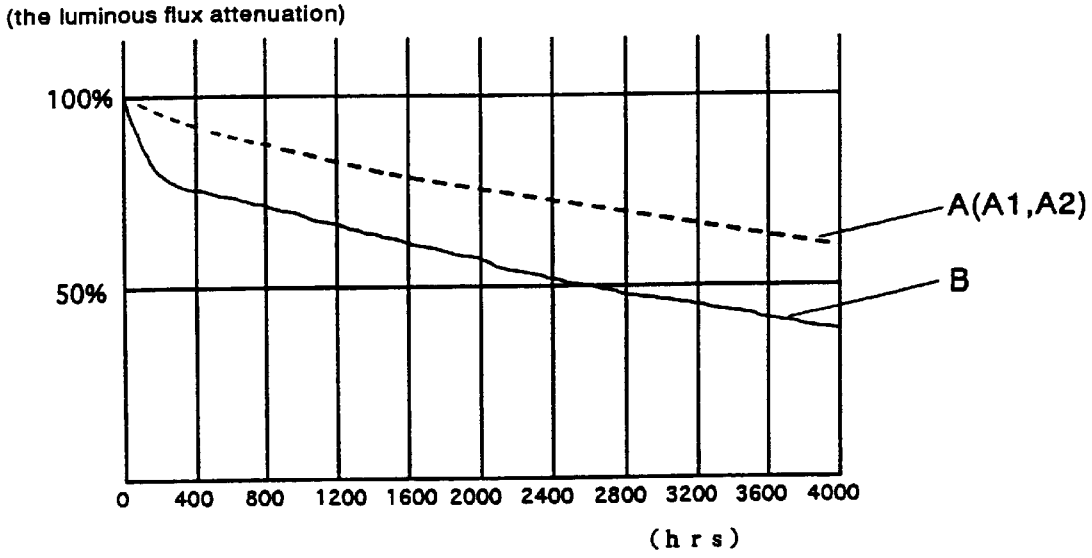
FIG. 5 is a graphic representation comparing the luminous flux attenuation rate per time of the lamp according to the present invention with that of a conventional lamp.

As can be seen from FIG. 5, the luminous flux of the conventional lamp (B) sharply dropped in the initial lighting period and then gently dropped, while the luminous flux of the lamp (A) did not sharply dropped in the initial lighting period but gently dropped throughout the test period. From this test it is found that the lamp (A) of the present invention had a greatly improved lift time as compared to the conventional lamp (B).

EXAMPLE 2

Five test samples (AI to AV) of lamp (A2) shown in FIG. 2 were prepared in which predetermined amounts of mercury, a metal halide or a mercury halide, argon gas and other inert gases were encapsulated and the spacing between the electrodes was 1.5 mm. Similarly, five test samples (BI to BV) of conventional lamp (B) were prepared under the same conditions as above.

These test samples were DC-operated with use of a 250W ballast to compare the screen brightness of the lamp (A2) of the present invention to that of the conventional lamp (B). The results are shown in Table 1.

TABLE 1

SCREEN BRIGHTNESS

| | Working distance (mm) | Aperture DIA (mm) | Total luminous flux (lm) |
|---|---|---|---|
| BI | 48 | 8 | 4410 |
| BII | 48 | 8 | 4550 |
| BIII | 48 | 8 | 4320 |
| BIV | 48 | 8 | 4250 |
| BV | 48 | 8 | 4520 |
| Average | | | 4410 |
| AI | 48 | 8 | 5200 |
| AII | 48 | 8 | 5150 |
| AIII | 48 | 8 | 5300 |
| AIV | 48 | 8 | 5500 |
| AV | 48 | 8 | 5400 |
| Average | | | 5410 |

As seen from Table 1, lamp (A2) having a seal-cut portion 7 on the extended tube portion 6 showed a remarkable increase in total luminous flux and hence in screen brightness.

It is to be noted that the working distance as used in Table 1 was a distance (L) from the opening of reflector 8 to aperture 9.

In turn, these test samples were tested for the extent of luminance unevenness and the percentage of luminance unevenness with use of a 40-inch screen. The percentage of luminance unevenness was obtained from the formula: $x/y \times 100$ where x is the lowest illuminance of an observable luminance unevenness and y is the highest illuminance of the observable luminance. The results are shown in Table 2.

TABLE 2

LUMINANCE UNEVENNESS TEST

| | Visual observability | Extent of luminance unevenness (mm) | Luminance unevenness (%) |
|---|---|---|---|
| BI | observable | 70 | 75 |
| BII | ditto | 70 | 70 |
| BIII | ditto | 50 | 80 |
| BIV | ditto | 70 | 70 |
| BV | ditto | 80 | 60 |

TABLE 2-continued

| LUMINANCE UNEVENNESS TEST | | | |
|---|---|---|---|
| | Visual observability | Extent of luminance unevenness (mm) | Luminance unevenness (%) |
| Average | | 68 | 71 |
| AI | unobservable | 0 | 0 |
| AII | ditto | 0 | 0 |
| AIII | ditto | 0 | 0 |
| AIV | ditto | 0 | 0 |
| AV | ditto | 0 | 0 |
| Average | | 0 | 0 |

As can be seen from Table 2, the lamp (A2) of the present invention did not cause any observable shadow (luminous unevenness) and exhibited excellent performance in terms of the extent of luminance unevenness and of the percentage of luminance unevenness.

While only certain presently preferred embodiments of the present invention have been described in detail, as will be apparent for those skilled in the art, certain changes and modifications can be made in embodiment without departing from the spirit and scope of the invention as defined by the following claims.

What is claimed is:

1. A direct current discharge lamp comprising:

a bulb portion containing therein a cathode and an anode which comprises a tungsten pin having a larger diameter than the cathode;

a first seal portion outwardly extending from the bulb portion on the anode side;

a second seal portion outwardly extending from the bulb portion on the cathode side;

a pair of feeder elements respectively inserted through the first and second seal portions for feeding electricity to the anode and cathode; and an extended tube portion interconnecting the bulb portion and the first seal portion, wherein the anode is extended from the bulb portion into the extended tube portion and the extended tube portion has an inner diameter larger than the outer diameter of the anode such that a space exists between the anode and the extended tube portion along a substantial portion of surface area of the anode contained within the extended tube portion.

2. A direct current discharge lamp as claimed in claim 1, wherein the anode and cathode face opposite each other with a predetermined spacing therebetween at a substantially central location of the bulb portion.

3. The direct current discharge lamp as claimed in claim 2, wherein said predetermined spacing is 0.5 mm to 3 mm.

4. The direct current discharge lamp as claimed in claim 2, wherein said predetermined spacing is 1.5 mm to 2 mm.

5. The direct current discharge lamp as claimed in claim 1, wherein said bulb portion is spherical.

6. A direct current discharge lamp comprising:

a bulb portion containing therein an anode and a cathode;

a first seal portion outwardly extending from the bulb portion on the anode side;

a second seal portion outwardly extending from the bulb portion on the cathode side;

a pair of feeder elements respectively inserted through the first and second seal portions for feeding electricity to the anode and cathode; and an extended tube portion interconnecting the bulb portion and the first seal portion, the extended tube portion being formed with a seal-cut portion.

7. A direct current discharge lamp as claimed in claim 6, wherein the anode and cathode face opposite each other with a predetermined spacing therebetween at a substantially central location of the bulb portion.

8. The direct current discharge lamp as claimed in claim 7, wherein said predetermined spacing is 0.5 mm to 3 mm.

9. The direct current discharge lamp as claimed in claim 7, wherein said predetermined spacing is 1.5 mm to 2 mm.

10. A light source comprising a reflector and a direct current discharge lamp, the lamp comprising:

a bulb portion containing therein an anode and a cathode, a first seal portion outwardly extending from the bulb portion on the anode side, a second seal portion outwardly extending from the bulb portion on the cathode side, a pair of feeder elements respectively inserted through the first and second seal portions for feeding electricity to the anode and cathode; and an extended tube portion interconnecting the bulb portion and the first seal portion and formed with a seal-cut portion, the first seal portion of the lamp being inserted into a central mounting hole of the reflector.

11. The light source lamp as claimed in claim 10, wherein said anode and cathode face opposite each other with the predetermined spacing therebetween at a substantially central location in the bulb portion.

12. The light source lamp as claimed in claim 11, wherein said predetermined spacing is in the range of about 0.5 mm to 3 mm.

13. The light source as claimed in claim 11, wherein said predetermined spacing is in the range of about of 1.5 mm to 2 mm.

14. A light source comprising a reflector and a direct current discharge lamp, the lamp comprising:

a bulb portion containing therein a cathode and an anode which comprises a tungsten pin having a larger diameter than the cathode;

a first seal portion outwardly extending from the bulb portion on the anode side;

a second seal portion outwardly extending from the bulb portion on the cathode side;

a pair of feeder elements respectively inserted through the first and second seal portions for feeding electricity to the anode and cathode; and an extended tube portion interconnecting the bulb portion and the first seal portion, wherein the anode is extended from the bulb portion into the extended tube portion, the first seal portion of the lamp is inserted into a central mounting hole of the reflector, and the extended tube portion has an inner diameter larger than the outer diameter of the anode such that a space exists between the anode and the extended tube portion along a substantial portion of surface area of the anode contained within the extended tube portion.

* * * * *